US005245310A

United States Patent [19]

Kirilloff et al.

[11] Patent Number: 5,245,310

[45] Date of Patent: Sep. 14, 1993

[54] RESISTOR GRID INSULATOR MOUNTINGS

[75] Inventors: Victor V. Kirilloff, Lincoln, Nebr.; Robert Cummins, Pittsburgh, Pa.; Richard Dawson, Pittsburgh, Pa.; William Benson, Pittsburgh, Pa.

[73] Assignee: Mosebach Manufacturing Company, Pittsburgh, Pa.

[21] Appl. No.: 684,219

[22] Filed: Apr. 12, 1991

[51] Int. Cl.[5] ..... H01C 10/14; H01C 3/00; H01C 7/22

[52] U.S. Cl. ..... 338/319; 338/273; 338/280; 338/281; 338/295

[58] Field of Search ..... 338/319, 295, 280, 281, 338/273

[56] References Cited

U.S. PATENT DOCUMENTS

| | | | |
|---|---|---|---|
| 1,695,234 | 12/1928 | Fuller . | |
| 3,358,074 | 12/1967 | Himes . | |
| 3,641,312 | 2/1972 | Ammerman et al. . | |
| 3,811,031 | 5/1974 | McBride et al. . | |
| 3,883,721 | 5/1975 | Paulson et al. . | |
| 4,100,526 | 7/1978 | Kirilloff et al. | 378/279 |

*Primary Examiner*—Marvin M. Lateef
*Attorney, Agent, or Firm*—Buchanan Ingersoll

[57] ABSTRACT

An improved frame supported resistor grid used for dynamic braking of electric motors is provided. The resistor grid has a metal frame and fan-folded strips of resistance material arranged in columns within the frame. The strips of resistance material are supported by studs affixed to the folds of the strips and the studs are, in turn, supported in ceramic bushing insulators. An intermediate member is affixed to the frame and receives the individual ceramic bushing insulators.

3 Claims, 3 Drawing Sheets

RESISTOR GRID INSULATOR MOUNTINGS

1. FIELD OF THE INVENTION

This invention relates to frame supported resistor grids or assemblies used for dynamic braking of electric motors. It is more particularly concerned with such grids having simplified mounting of resistor elements in a frame which facilitates assembly and resists vibration.

BACKGROUND OF THE INVENTION

Frame supported resistor grids such as the article of U.S. Pat. No. 4,100,526 are widely used in diesel electric locomotives. The heat generated by such resistors in their braking function and the vibration inherent in any railroad vehicle creates problems not easily solved. The units generally comprise one or more fan-folded strips of resistance material arranged in columns supported by insulators in a grounded metal frame. The insulators mounted in the frame hold the strip in position by metal studs affixed to each fold of the strip, which studs are received in the insulators. The studs are generally welded to the strip of resistance material. The insulators, which are often ceramic, but may be of other non-conductive material, are affixed to the frame in various ways. In FIG. 2 of U.S. Pat. No. 4,100,526 an E ring is shown as the device for anchoring a cylindrical ceramic insulator in a metal frame.

While the prior art devices for mounting ceramic insulators in metal frames are reasonably satisfactory, the insulators can be loosened by vibration. E rings and similar frictional devices must have spring-like projections to withstand the vibration of railroad cars. Steel springs are made from spring steel which has a carbon content of about 1%. It cannot be welded because the heat of the weld would "draw" its temper, that is, destroy its springiness.

SUMMARY OF THE INVENTION

In our invention the insulators, preferably ceramic, are supported in a metal frame by means of an intermediate member which may be affixed to the insulator bushings or may be affixed to the metal frame.

In a first embodiment of our invention, ceramic bushings are molded into a heat-resistant copolymer plastic member which is attached to a metal frame element.

In a second embodiment of our invention, ceramic insulating bushings are formed with a circumferential groove and a longitudinal surface groove intersecting the circumferential groove and are attached to a metal member by cylindrical metal casings just large enough to accept the ceramic bushing, with a surface depression or dimple in the casing that will be accepted by the longitudinal surface groove of the bushing. The circumferential groove in the bushing is dimensioned so as to be shallower than the longitudinal surface groove. After the bushing has entered the casing, it is twisted so that the dimple locks or jams in the circumferential groove.

PREFERRED MODE

Figure 1:
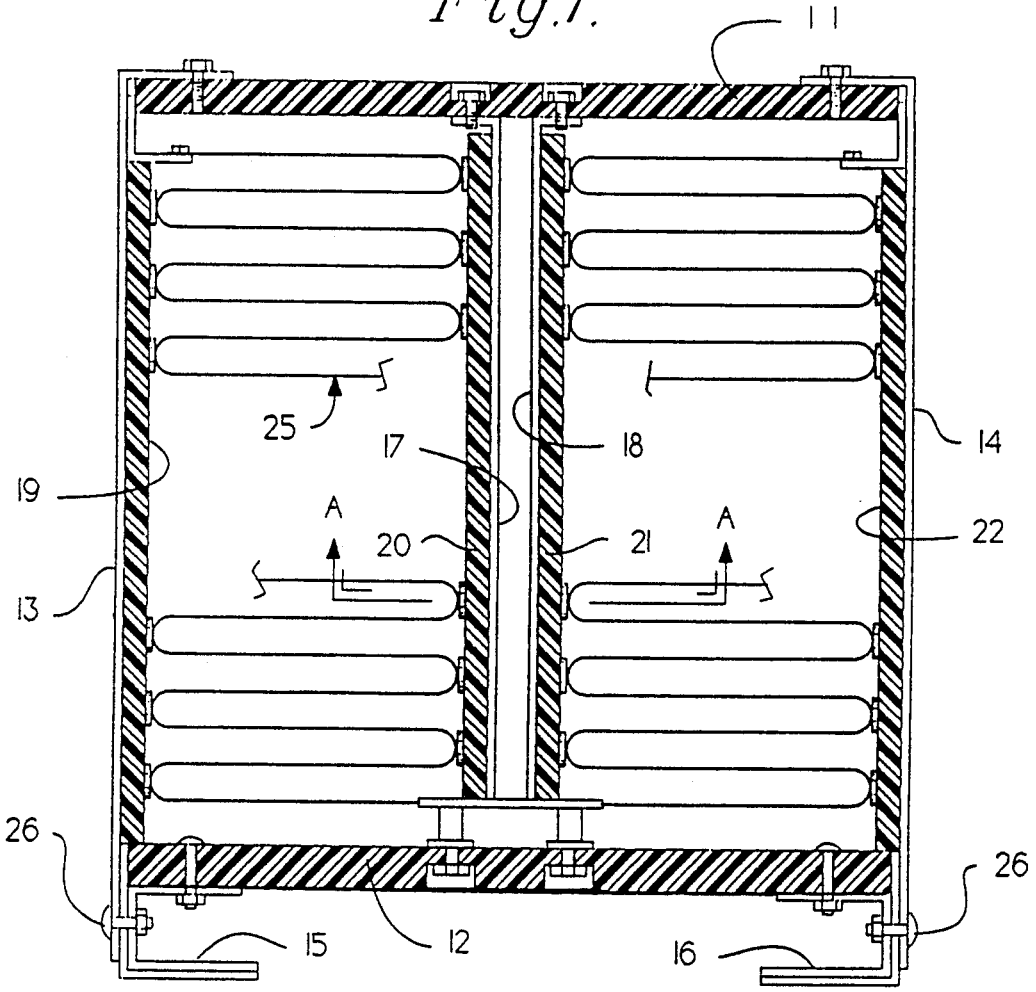
FIG. 1 is an elevation of a two column weave grid exemplifying a first embodiment of our invention as above-described.

The embodiment of our invention first mentioned hereinabove is illustrated in FIG. 1 showing a grid with center ventilation. The supporting frame comprises a top copolymer panel 11 and a bottom copolymer panel 12 attached to metal left and right side members 13 and 14 respectively, which, at their lower ends are attached to mounting fixtures 15 and 16 respectively by screws or bolts 26. Intermediate side members 13 and 14 are metal left and right center members 17 and 18 respectively. In FIG. 1, those intermediate members are spaced from each other as is shown in our U.S. Pat. No. 4,847,585 for Center Ventilated Resistor Grid. Our invention here to be described is not limited to center ventilated grids, however. To the inside faces of side members 13 and 14 and to the outside faces of intermediate members 17 and 18 are affixed panels of copolymer material 19, 20, 21 and 22 respectively. Those panels are molded around individual ceramic insulators as will be described hereinafter, which mate with the fan-folded strip of resistance material 25 as will be described.

Figure 2:
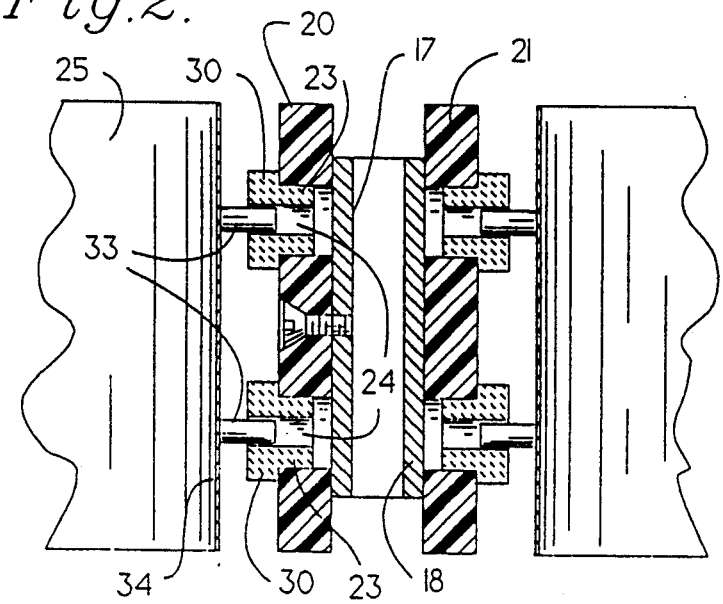
FIG. 2 is a detail of the stud and bushing arrangement of FIG. 1.
Figure 3:
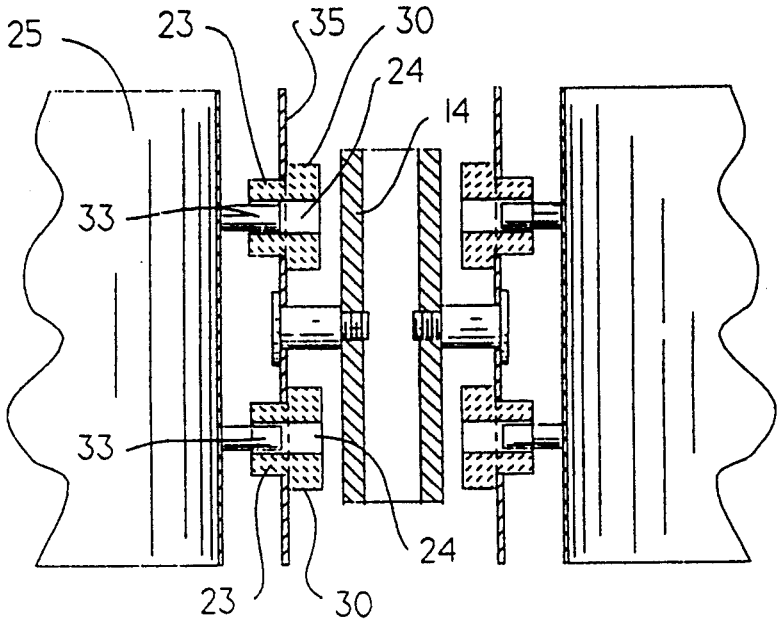
FIG. 3 is a detail of another stud and bushing arrangement which may be used in a second embodiment of our invention.

FIGS. 2 and 3 are details in plan of two embodiments of our invention. In FIG. 2 ceramic bushing 23 is cylindrical with an external shoulder 30. The copolymer panel 22 is molded around the smaller end of bushing 23 and is attached to a frame member, side or center, for example 13 or 17. Bushing 23 is formed with a central hole 24 extending through it, dimensioned to accept stud 33 welded or otherwise affixed to a fold 34 of resistance strip 25. In FIG. 3, bushings 23 are fixed in metal support panel 35 which is attached to a metal frame member 14.

Figure 4:
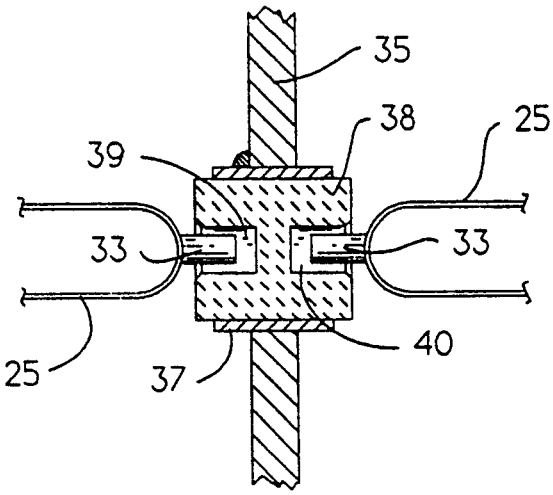
FIG. 4 is a detail of the second embodiment of our invention suitable for a grid with a single intermediate frame member between columns.
Figure 5:
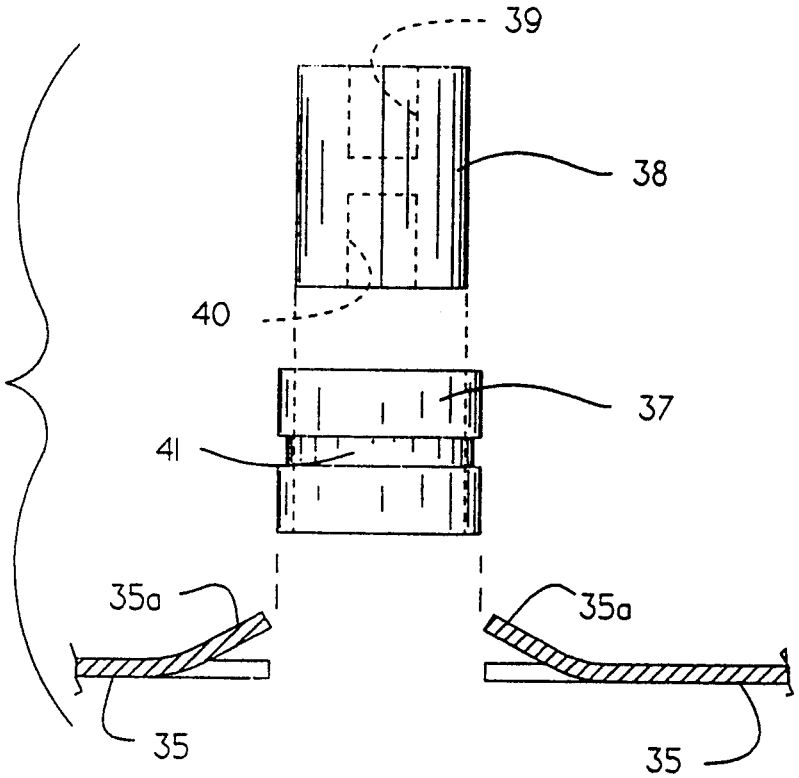
FIG. 5 is an exploded view of elements of FIGS. 3 and 4.
Figure 6:
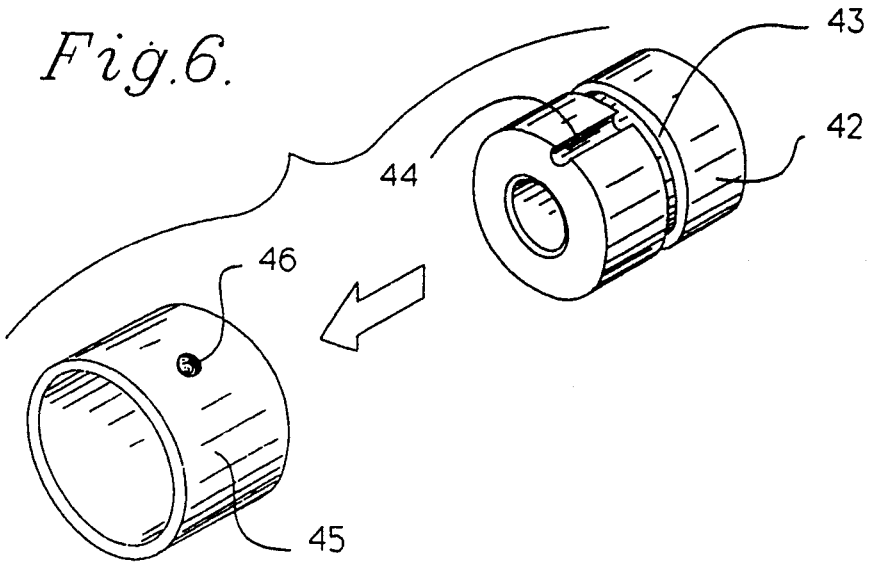
FIG. 6 is an exploded view of a locked in place bushing.

The embodiment of our invention utilizing individual metal shells or casings for its ceramic insulators is illustrated in detail in FIGS. 4, 5 and 6. As shown in the FIG. 4, a cylindrical stainless steel casing 37 fitting around a ceramic bushing 38 is fixed in a frame member or support panel 35 of metal. The casing 37 extends on both sides of the support member and is attached thereto by tack welding or other convenient means. Instead of a center hole extending through the bushing, two holes 39 and 40 are formed one from each end, preferably coaxial, but not meeting. Those holes are dimensioned to accept studs 33 as before mentioned. The bushing 38 may be free floating in casing 37 as the fan-folded resistor strip on each side will exert more or less equal but opposite pressures on it. If a free floating bushing is not desired, the bushing hole in its metal support member 35 may be punched to have opposed tabs **35*a* facing each other and casing 37 may have a circumferential groove 41 around it, as is illustrated in FIG. 5. After the bushing 38 is inserted, tabs 35*a* are then bent down to engage groove 41 and lock casing 37** in place.

Another way of locking a bushing in place adapted to the arrangement of FIG. 3 is shown in FIG. 6. Bushing 42 is formed with a shallow circumferential exterior groove 43 and a deeper longitudinal exterior groove 44 extending at least from one end to groove 43. Casing 45 is formed with a dimple or inward protrusion 46 which will not engage groove 44 but does engage groove 43. When bushing 42 is inserted into casing 45 dimple 46 will encounter groove 43 and the bushing and casing may be twisted against each other so that they are locked in place.

We claim:

1. An improved resistor grid having a metal frame and fan-folded strips of resistance material arranged in columns within said frame and supported therein by studs affixed to the folds of said strips and insulators supported by said frame and receiving said studs, wherein the improvement comprises a metal intermediate member positioned between said frame and said insulators, said intermediate member being affixed to said frame and said insulators and said insulators being ceramic bushings set in individual cylindrical metal casings affixed to said metal intermediate member.

2. The improved resistor grid of claim 1 in which said casings have an internally projected dimple in their walls and the said ceramic bushings have an external longitudinal groove which accepts said projecting dimple and a circumferential external groove which jams or locks with said dimple when said bushing is inserted into its casing until said dimple is positioned in said circumferential groove and said casing and said bushing are twisted against each other.

3. The improved resistor grid of claim 1 in which said ceramic bushings have a circumferential external groove and said metal members formed with a hole of a radius which accepts said bushing except for at least two internally projecting tabs which, when bent up, fit over said circumferential external groove of said bushing but when bent down lock into said external circumferential groove.

* * * * *